US006630436B1

(12) United States Patent
York et al.

(10) Patent No.: US 6,630,436 B1
(45) Date of Patent: Oct. 7, 2003

(54) IMPACT RESISTANT SOLID COMPONENT

(75) Inventors: David William York, Newcastle Upon Tyne (GB); Zoe Dyter, Newcastle upon Tyne (GB); Martin Ian James, Camberly (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/830,619

(22) PCT Filed: Oct. 27, 1999

(86) PCT No.: PCT/US99/25267

§ 371 (c)(1),
(2), (4) Date: Apr. 27, 2001

(87) PCT Pub. No.: WO00/26335

PCT Pub. Date: May 11, 2000

(30) Foreign Application Priority Data

Oct. 30, 1998 (EP) ..... 9823695

(51) Int. Cl.[7] ..... C11D 3/386; C11D 3/39; C11D 3/37; C11D 17/00; C11D 17/06

(52) U.S. Cl. ..... 510/392; 510/349; 510/374; 510/376; 510/405; 510/438; 510/441; 510/446; 510/447; 510/475; 510/530; 435/188

(58) Field of Search ..... 510/349, 367, 510/376, 392, 374, 438, 405, 441, 446, 447, 475, 530; 435/188

(56) References Cited

U.S. PATENT DOCUMENTS

| | | | | | |
|---|---|---|---|---|---|
| 3,664,961 | A | * | 5/1972 | Norris | 510/305 |
| 4,379,080 | A | | 4/1983 | Murphy | 510/350 |
| 5,167,852 | A | * | 12/1992 | Emery et al. | 510/513 |
| 5,281,356 | A | * | 1/1994 | Tsaur et al. | 510/393 |
| 5,324,445 | A | * | 6/1994 | Langley et al. | 510/321 |
| 5,324,649 | A | * | 6/1994 | Arnold et al. | 435/187 |
| 5,744,152 | A | | 4/1998 | Langley et al. | 424/408 |

FOREIGN PATENT DOCUMENTS

| | | | |
|---|---|---|---|
| EP | 0 429 108 | A2 | 5/1989 |
| EP | 0 468 824 | A2 | 1/1992 |
| WO | WO 94/15010 | | 7/1994 |
| WO | WO 94/26883 | | 11/1994 |
| WO | WO 96/16151 | A1 * | 5/1996 |
| WO | WO 97/28781 | A1 * | 8/1997 |

* cited by examiner

*Primary Examiner*—Lorna M. Douyon
(74) *Attorney, Agent, or Firm*—Julia A. Glazer; Brahm J. Corstanje; Kim W. Zerby

(57) ABSTRACT

The solid component comprises a finely divided component, preferably a sensitiser, and a specific polymeric component, whereby the solid component has a tressed Heubach Index of less than 1000. The solid component is preferably present in the detergent composition, preferably in a granular composition, a tablet or bar.

6 Claims, No Drawings

IMPACT RESISTANT SOLID COMPONENT

TECHNICAL FIELD

The present invention relates to solid components which have an improved impact resistancy and/or a reduced dusting.

BACKGROUND TO THE INVENTION

In various technical applications or in various products, materials are used which can sensitise the skin, eyes or respiratory system upon contact. For example powdered materials such as enzymes may come into contact with the skin or eyes or may even be inhaled during handling, in particular when in the form of very fine powder or dust, causing thereby irritation and even more severe health problems. Also reactive powdered materials such as bleach may react with the skin or eyes and cause irritation. Furthermore, various products contain materials which whilst they do not sensitise or irritate the skin, eyes or respiratory system in their normal form, may cause these problems when in the form of very finely divided powder or dust.

Thus when handling these materials, strict precautions need to be taken and special hygiene systems need to be in place to control the exposure to these materials. Nowadays, all manufacturers of products comprising for example enzymes have such systems in place. This not only results in an increased cost of using these materials, but it also reduces the ease of handling and processing these materials and moreover limits the amounts of these materials which can be used.

The inventors have now found a way to reduce the risk of exposure to these sensitising or finely divided or dusting materials. They have found that when the materials are bound by and/or coated with a specific polymeric component, the resulting slid component is more impact resistant.

It is well-known to encapsulate for example enzymes with a coating agent or even layers of coating agent, to protect the enzymes from reacting with other materials. This has as a disadvantage that the encapsulated enzyme granules contain only a limited amount of active enzyme. Furthermore, the inventors have found that these encapsulated enzymes still form dust during handling and are thus also sensitising upon exposure.

The inventors have however found that the incorporation of specific polymer materials improves the impact resistancy of the components containing these materials. This reduces the formation of very fine powder or dust during handling and thus the exposure of the skin, eyes and respiratory system to the material. This not only allows a limitation of the hygiene systems which needs to be in place, thereby reducing the cost and the complexity of handling, but it also allows the use of higher amounts of these materials. Furthermore, these polymers are very effective and only small amounts need to be used, thus high active components can be obtained.

SUMMARY OF THE INVENTION

The invention provides a solid component comprising a finely divided component and a polymeric component present as a binder and/or a coating, whereby the solid component has a Stressed Heubach Index of less than 1000, as set out herein. Preferably, the solid component has a Stressed Heubach index of less than 500 or even less than 300 or more preferably less than 200 or even 100.

The invention also provides a solid detergent component comprising an enzyme or a bleaching component or mixtures thereof, and an impact modifier, preferably having a Stressed Heubach Index of less than 1000. The impact modifier preferably comprises said polymeric component.

The invention also relates to the use of a polymeric component, preferably comprising at least two polymeric compounds, preferably a core-shell polymeric component, in a solid component containing a finely divided component, to improve the impact resistancy of the solid component.

The solid component may preferably be part of a detergent composition, preferably the composition is in the form of a detergent granule, tablet or bar.

DETAILED DESCRIPTION OF THE INVENTION

Stressed Heubach Index and Test

The solid component has a Stressed Heubach Index of less than 1000, preferably less than 500 or even less than 300, 200 or even less than 100.

The Stressed Heubach Index for the purpose of the invention is obtained by conducting with the solid component a Heubach test, as known in the art, which is stressed by alteration of the speed and type of balls used.

In this test a modified Heubach dust meter equipment is used to measure attrition dust formed during the test. The equipment used herein is as supplied by Heubach Engineering GMbH, Germany, with the modification of the rotation speed of the impeller being 75±1 rpm and the balls being of Tungsten carbide.

It comprises a pot containing a screw-on cap, an air in-let and out-let, a sample holder, to hold the amount of solid component and the balls, a filter in a filter holder, a silica gel holder containing silica gel to dry the air entering the air inlet before it contacts the sample holder.

Dust is generated from a certain amount of the solid component by the mechanical action of Tungsten carbide balls inside the pot against the component. Namely, the rotation action moves the balls over the component which causes attrition and formation of dust. Dust particles of less than 50 $\mu$m are swept from the pot by a controlled dried air stream (passed through the silica and the filter and passed the sample holder) and collected on the GF/C filter. These dust particles are weighed once the test is stopped. The attrition dust particles are given as $\mu$g total dust/g component, which equals the stressed Heubach index ±10%. The instrument is water cooled to ensure correct air volume measurement and to prevent overheating.

When the equipment is operating, the impeller rotates at 75±1 rpm. The Tungsten carbide balls are of the dimensions of the standard steel balls supplied by Heubach under part No 1.43.H039, having a 20 mm diameter. The instrument is calibrated at Heubach to deliver 400 litre of air during the pre-test period of 10 minutes and the test period of 10 minutes; the air flow rate is thus to be set to 20 litre/min. The filters are of glass fibre, as available as Whatman GF/C, having a 47 mm diameter. The silica material is of particle size of about 2.5–5 mm obtainable from Fluka, Cat No 85342, 3–6 mm.

Prior to the start of the test, the equipment and the solid component therein should be set ready to use with air flowing, for 10 minutes, to stabilise the system. Then, the solid component and the filter (separately) are weighed, to determine their weights before the test, to an accuracy of 0.001 g.

Also weighed out is Ws, the weight of the component to an accurancy of 0.001 g, which is equivalent to 16.25×the density of the component, 16.25 being a constant determined for the Heubach test and applicable in the Stressed Heubach test.

The solid component together with the four balls and the filter are then placed back in the pot and the rotation is started and only stopped after 400 L of air have passed through the pot (after 10 minutes). The air stream is also stopped and the dust which is deposited on the filter and inside the filter holder is weighed to an accuracy of 0.0001 g.

The micrograms of dust per gram of component is calculated as being $$= \frac{(W2 - W1) \times 10^6}{Ws} \ \mu g/g$$

W2=final weight of filter and dust

W1=initial weight of filter

Ws=weight of component

For the present invention this number can have an accuracy of 10%. The stressed Heubach index equals thus this number ±10%.

Solid Component

In one embodiment, the solid component according to the invention preferably comprises the finely divided component intimately mixed with the polymeric component. Alternatively the finely divided component may be coated with the polymeric component. Alternatively, it may be preferred that the intimate mixture of the finely divided component with one part of the polymeric component is coated with the other part of the polymeric component.

'Intimately mixed' when used herein means for the purpose of the invention that the finely divided component, or at least one of the polymeric compounds present in the polymeric component, when applicable, are substantially homogeneously divided in the component. 'Intimate mixture' and 'intimate mixing' should be interpreted accordingly.

The intimate mixture may subsequently be submitted to one or more granulation steps to form the solid component. These subsequent steps are preferably agglomeration or extrusion steps, optionally followed by spheronisation. Alternatively, or in addition to the intimate mixing step and optional subsequent steps, the formation of the solid component comprises a coating step. This may be done by any method of coating, including granulation or spraying on, including by use of a pan coater, rotating drum coater, spray fluidised granulators or belts spraying.

The solid component typically comprises from 5 to 95% by weight of the polymeric component, more preferably from 10% to 85%, or even from 20% to 75% by weight, and depending on the finely divided component used and the application of the solid component, lower levels of polymeric material may be preferred, such as from 20% to 70% or even 20% to 50% by weight.

The solid component typically comprises the finely divided component at a level of 5% to 95%, more preferably from 15% to 90% or even from 25% to 75%, and depending on the type of finely divided component polymeric component and application of the solid component, higher levels of finely divided component may be preferred, such as minimum levels of 30% or even 35% or 40%.

The solid component may comprise small amounts of solvent. The solvent may be added when mixing the polymeric component and the finely divided component, or when coating the finely divided component with the polymeric component, and/or the solvent may be present in the finely divided component or the polymeric component. Typically, less than 15% or even less than 10% or more preferably less than 7% or even 5% by weight of the component of solvent is present. Preferably the solvent comprises water.

The solid component may be incorporated in any product which normally comprises finely divided components, including pharmaceutical products, cosmetics, and cleaning products. In a preferred embodiment, the solid component is in the form of detergent components or compositions, preferably in the form of a detergent granule. The component may then preferably have a weight average particle size form 100 to 3000 microns, preferably from 200 to 2000 microns or even from 350 to 1500 microns or even 400 to 1200 microns.

The density of the solid component, in particular when present in or in the form of a detergent composition or component is preferably from 300g/litre to 2000 g/litre, more preferably from 400g/litre to 1500g/litre.

The solid component may also be incorporated in a granular detergent composition, a liquid detergent composition, a detergent tablet, or a detergent bar.

The solid component may comprise additional ingredients. The nature of the additional ingredients will depend on the nature of the solid component and the application thereof. For example, the solid component may comprise additional binders, coating agents, stabilisers, colorants, desiccants and/or surfactants, in particular when the solid component is in the form of a detergent component or present in a detergent component or composition.

The levels of any additional ingredients which may be present, will depend on the application of the solid component, the nature of the solid component and the finely divided components and polymeric component therein. Typical levels are 0% to 70% or even 0% to 50%, or even 5% to 50% or 10% to 40% by weight of the solid component.

Polymeric Component

In accord with one embodiment of the invention, the polymeric component comprises preferably at least two polymeric compounds. It may be preferred that the polymeric compounds of the polymeric component are intimately mixed, prior to mixing with the finely divided component or coating the finely divided component. It may be preferred that the polymeric component comprises a graft polymeric material, or a block-polymeric material. Highly preferred is that the polymeric component comprises a core-shell polymeric material.

The polymeric component may also comprise mixtures of these polymeric materials.

It is preferred that at least one of the polymeric compounds, and preferably the polymeric component, has a film forming temperature of 70° C. or less, preferably 60° C. or even 50° C. or less. This can be determined by measuring the minimum film forming temperature with a film forming temperature bar, following ASTM D 2354-91.

It may be preferred that the polymeric component comprises an elastomer polymeric compound or a toughening adhesive or mixtures thereof, as defined in the 1996 version of the European standard EN 923199X.

It has been found particularly beneficial when the polymeric component comprises at least one polymeric compound which comprises in the polymeric structure or backbone a polymerised monomer unit which is water-soluble, when in the form of the polymerisable monomer, prior to polymerisation. Hereby, the monomer unit, when in the form of the monomer, is preferably soluble in water having a pH of 6 or more, preferably 8 or more. Hereby, it may also be preferred that the monomer, in the form of the monomer, is only partially water-soluble or more preferably substantially insoluble in water of pH of below 3 or even 4 or even 5. Highly preferred monomers for polymerisation to form the polymeric structure or the polymeric backbone are polymerisable carboxylic acids including organic carboxylic acids, amino acids, acrylic acid, maleic acid.

Highly preferred may be that the polymeric component comprises a core-shell polymeric material, preferably having a shell polymer having a polymeric backbone comprising one or more water-soluble monomer units, as described above. The core-shell polymers can be made by any method known in the art, such as described in WO 98/23658, WO 96/07703, EP 114288, EP-A-0532234, U.S. Pat. No. 4876313, EP-A-0348565, U.S. Pat. No. 3985703, U.S. Pat. No. 3984497, U.S. Pat. No. 4096202, U.S. Pat. No. 4034013, U.S. Pat. No. 4304709, U.S. Pat. No. 3944631, U.S. Pat. No. 4306040 and U.S. Pat. No. 4495324. Typically, core-shell polymers are formed by grafting a polymeric shell onto a polymeric core. Thus, it may be preferred that the core-shell polymer is an impact modifying grafted core-shell polymer.

The polymeric structure of the polymeric compounds herein may preferably comprise one or more the following polymerisable monomers or substituted monomers or derivatives thereof: (meth)acrylic acid; alkyl(meth) acrylates; hydroxy and hydroxy alkyl (meth)acrylates; (meth)acrylic acid esters with $C_1$ to $C_{18}$ alcohols; alkoxy (polyalkyleneoxide) (meth)acrylates; amides of (meth) acrylic acid; acid substituted (meth)acrylamides; basic substituted (meth)acrylates; poly(meth)acrylate esters; alkenes; alkynes; butadiene; vinyl compounds including vinyl esters, e.g. esters of carboxylic acid or salts, vinyl chloride, vinyl sulphonic acid; carboxylic acids and derivatives thereof, including maleic acid, itaconic acid; itaconic acid; fumaric acid, crotonic acid.

A preferred core may be a methacrylate—butadiene—styrene core. A preferred shell is a polymethacrylate shell, preferably modified with additional polymerised monomer units which are water-soluble in the monomer form, as described above Finely Divided Components The finely divided component may be a finely dispersible liquid component or more preferably a powdered component, or mixtures thereof.

The powdered component preferably has an weight average particle size of less than 1100 microns, preferably less than 850 microns, or even less than 700 microns or even less than 500 microns, and it may be preferred that the weight average particle size is less than 350 microns or preferably less than 200 microns, most preferably less than 100 microns or even less than 50 microns.

When used herein, the finely divided components preferably is a sensitiser, comprising any material which upon exposure to it, can cause irritation, in particular of the skin, eyes and respiratory system. The irritation may be in the form of itching of the skin, eyes or respiratory system, skin rash, redness of the eyes, inhalation problems, coughing, or more severe forms thereof. The sensitiser component in the solid component of the invention, may depend on the application of the solid component.

The finely divided component may comprise fine particle size powdered organic or inorganic alkaline salts or acids.

A particular preferred finely divided component herein is an enzymes or a bleach component, including bleach activators.

Enzymes

Enzymes are preferred finely divided component for incorporation in the solid component of the invention. When the solid component is present in a detergent composition, the enzymes herein are normally incorporated at levels from 0.0001% to 2% of pure enzyme by weight of the detergent composition, preferably 0.001 to 1.5% or even 0.005 to 1.3% by weight of the composition.

The enzymes usefule herein include enzymes selected from cellulases, hemicellulases, peroxidases, proteases, gluco-amylases, amylases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase or mixtures thereof.

The cellulases usable in the present invention include both bacterial or fungal cellulases. Preferably, they will have a pH optimum of between 5 and 12 and a specific activity above 50 CEVU/mg (Cellulose Viscosity Unit). Suitable cellulases are disclosed in U.S. Pat. No. 4,435,307, Barbesgoard et al, J61078384 and WO96/02653 which discloses fungal cellulase produced respectively from Humicola insolens, Trichoderma, Thielavia and Sporotrichum. EP 739 982 describes cellulases isolated from novel Bacillus species. Suitable cellulases are also disclosed in GB-A-2.075.028; GB-A-2.095.275; DE-OS-2.247.832 and WO95/26398.

Examples of such cellulases are cellulases produced by a strain of Humicola insolens (Humicola grisea var. thermoidea), particularly the Humicola strain DSM 1800. Other suitable cellulases are cellulases originated from Humicola insolens having a molecular weight of about 50KDa, an isoelectric point of 5.5 and containing 415 amino acids; and a ~43kD endoglucanase derived from Humicola insolens, DSM 1800, exhibiting cellulase activity; a preferred endoglucanase component has the amino acid sequence disclosed in PCT Patent Application No. WO 91/17243. Also suitable cellulases are the EGIII cellulases from Trichoderma longibrachiatum described in WO94/21801, Genencor, published Sep. 29, 1994. Especially suitable cellulases are the cellulases having color care benefits. Examples of such cellulases are cellulases described in European patent application No. 91202879.2, filed Nov. 6, 1991 (Novo). Carezyme and Celluzyme (Novo now EP4952157 Nordisk A/S) are especially useful. See also WO91/17244 and WO91/21801. Other suitable cellulases for fabric care and/or cleaning properties are described in WO96/34092, WO96/17994 and WO95/24471.

Peroxidase enzymes are useful herein include, for example, horseradish peroxidase, ligninase and haloperoxidase such as chloro- and bromo-peroxidase. Peroxidase-containing detergent compositions are disclosed, for example, in PCT International Application WO 89/099813, WO89/09813 and in European Patent application EP No. 91202882.6, filed on Nov. 6, 1991 now EP540784 and EP No. 96870013.8, filed Feb. 20, 1996 now EP927242. Also suitable is the laccase enzyme.

Other preferred enzymes that can be included in the component of the present invention include lipases. Suitable lipase enzymes for detergent usage include those produced by microorganisms of the Pseudomonas group, such as *Pseudomonas stutzeri* ATCC 19.154, as disclosed in British Patent 1,372,034. Suitable lipases include those which show a positive immunological cross-reaction with the antibody of the lipase, produced by the microorganism *Pseudomonas fluorescent* IAM 1057. This lipase is available from Amano Pharmaceutical Co. Ltd., Nagoya, Japan, under the trade name Lipase P "Amano," hereinafter referred to as "Amano-P". Other suitable commercial lipases include Amano-CES, lipases ex *Chromobacter viscosum*, e.g. *Chromobacter viscosum* var. lipolyticum NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. Especially suitable lipases are lipases such as M1 Lipase$^{R\ and}$ Lipomax$^{R}$ (Gist-Brocades) and Lipolase$^{R}$ and Lipolase Ultra$^{R}$(Novo) which have found to be very effective when used in combination with the compositions of the present invention. Also suitables are the lipolytic enzymes described in EP 258 068, WO 92/05249 and WO 95/22615 by Novo Nordisk and in WO 94/03578, WO 95/35381 and WO 96/00292 by Unilever.

Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor); WO 90/09446 (Plant Genetic System) and WO 94/14963 and WO 94/14964 (Unilever).

Suitable proteases herein are for example the subtilisins which are obtained from particular strains of *B. subtilis* and *B. licheniformis* (subtilisin BPN and BPN'). One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE®, DURAZYM® and SAVINASE® from Novo and MAXATASE®, MAXACAL, PROPERASE® and MAXAPEM (protein engineered Maxacal) from Gist-Brocades. Proteolytic enzymes also encompass modified bacterial serine proteases, such as those described in European Patent Application Serial Number 87 303761.8, filed Apr. 28, 1987 (particularly pages 17, 24 and 98), now EP251446 and which is called herein "Protease B", and in European Patent Application 199,404, Venegas, published Oct. 29, 1986, which refers to a modified bacterial serine protealytic enzyme which is called "Protease A" herein. Suitable is the protease called herein "Protease C", which is a variant of an alkaline serine protease from Bacillus in which lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein.

A preferred protease referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of Bacillus amyloliquefaciens subtilisin, as described in WO95/10591 and in the patent application of C. Ghosh, et al, "Bleaching Compositions Comprising Protease Enzymes" having U.S. Ser. No. 08/322,677, filed Oct. 13, 1994 now U.S. Pat. No. 5,677,272. Also suitable is a carbonyl hydrolase variant of the protease described in WO95/10591, having an amino acid sequence derived by replacement of a plurality of amino acid residues replaced in the precursor enzyme corresponding to position +210 in combination with one or more of the following residues: +33, +62, +67, +76, +100, +101, +103, +104, +107, +128, +129, +130, +132, +135, +156, +158, +164, +166, +167, +170, +209, +215, +217, +218, and +222, where the numbered position corresponds to naturally-occurring subtilisin from Bacillus amyloliquefaciens or to equivalent amino acid residues in other carbonyl hydrolases or subtilisins, such as *Bacillus lentus* subtilisin (co-pending patent application U.S. Ser. No. 60/048,550, filed Jun. 04, 1997).

Also suitable for the present invention are proteases described in patent applications EP 251 446 and WO 91/06637, protease BLAP® described in WO91/02792 and their variants described in WO 95/23221.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

Amylases can also be included in the component of the inevntion. WO94/02597, Novo Nordisk A/S published Feb. 03, 1994 describes amylases. See also WO95/10603, Novo Nordisk A/S, published Apr. 20, 1995. Other amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Other suitable amylases are stability-enhanced amylases described in WO94/18314, published Aug. 18, 1994 and WO96/05295, Genencor, published Feb. 22, 1996 and amylase variants having additional modification in the immediate parent available from Novo Nordisk A/S, disclosed in WO 95/10603, published April 95. Also suitable are amylases described in EP 277 216, WO95/26397 and WO96/23873 (all by Novo Nordisk).

Examples of commercial -amylases products are Purafect Ox Am from Genencor and Termamyl, Ban ,Fungamyl and Duramyl®, all available from Novo Nordisk A/S Denmark. WO95/26397 describes other suitable amylases: -amylases characterised by having a specific activity at least 25% higher than the specific activity of Termamyl at a temperature range of 25C to 55C and at a pH value in the range of 8 to 10, measured by the Phadebas -amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used.

Nowadays, it is common practice to modify wild-type enzymes via protein/genetic engineering techniques in order to optimise their performance efficiency in the cleaning compositions of the invention. For example, the variants may be designed such that the compatibility of the enzyme to commonly encountered ingredients of such compositions is increased. Alternatively, the variant may be designed such that the optimal pH, bleach or chelant stability, catalytic activity and the like, of the enzyme variant is tailored to suit the particular application.

In particular, attention should be focused on amino acids sensitive to oxidation in the case of bleach stability and on surface charges for the surfactant compatibility. The isoelectric point of such enzymes may be modified by the substitution of some charged amino acids, e.g. an increase in isoelectric point may help to improve compatibility with anionic surfactants. The stability of the enzymes may be further enhanced by the creation of e.g. additional salt bridges and enforcing calcium binding sites to increase chelant stability. Special attention must be paid to the cellulases as most of the cellulases have separate binding domains (CBD). Properties of such enzymes can be altered by modifications in these domains.

Bleaching Component

The finely divided component preferably comprises a bleaching component. The bleaching component herein preferably comprises a chlorine-based bleach, a hydrogen peroxide source or more preferably a bleach activator or bleach precursor or mixtures of these bleaching agents.

The bleaching components are preferred finely divided component for incorporation in the solid component of the invention. When the solid component is present in a detergent composition, the bleaching component herein are normally incorporated at levels from 0.3% to 40% by weight of the detergent composition, preferably 1%to 50% or even 1.5 to 30% by weight of the composition.

Examples of inorganic perhydrate salts include perborate, percarbonate, perphosphate, persulfate and persilicate salts. The inorganic perhydratc salts are normally the alkali metal salts. The inorganic perhydrate salt may be included as the crystalline solid without additional protection. For certain perhydrate salts however, the preferred executions of such granular compositions utilise a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps.

Sodium perborate is a preferred perhydrate salt and can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Potassium peroxymonopersulfate is another inorganic perhydrate salt of use in the detergent compositions herein.

Bleach Activators or Bleach Precursors

The finely divided component preferably comprises a bleach activator or a bleach precursor.

Preferred are organic peroxyacids or precursors thereto. Peroxyacid bleach precursors are preferably compounds which react with hydrogen peroxide in a perhydrolysis reaction to produce a peroxyacid.

Generally peroxyacid bleach precursors may be represented as

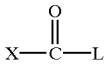

where L is a leaving group and X is essentially any functionality. Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

The leaving group, hereinafter L group, must be sufficiently reactive for the perhydrolysis reaction to occur within the optimum time frame (e.g., a wash cycle). However, if L is too reactive, this activator will be difficult to stabilise for use in a bleaching composition.

Preferred L groups are selected from the group consisting of:

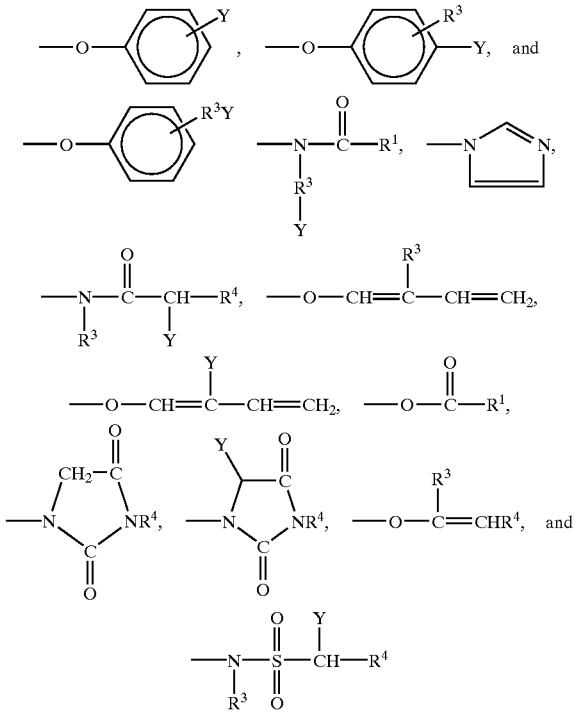

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^{+(R3)}{}_4X^-$and $O\leftarrow N(R^3)_3$ and most preferably $—SO_3^-M^+$and $—CO_2^-M^+$wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl percarboxylic acid bleach precursors form percarboxylic acids on perhydrolysis. Preferred precursors of this type provide peracetic acid on perhydrolysis. Preferred alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1,2 and 6 carbon atoms. Tetraacetyl ethylene diamine (TAED) is particularly preferred. The TAED is preferably not present in the agglomerated particle of the present invention, but preferably present in the detergent composition, comprising the particle.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide substituted alkyl peroxyacid precursor compounds are suitable herein, including those of the following general formulae:

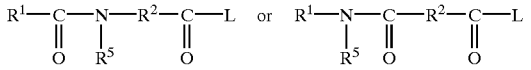

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Highly preferred examples of bleach precursors of this type include amide substituted peroxyacid precursor compounds selected from (6-octanamido-caproyl) oxybenzenesulfonate, (6-decanamido-caproyl) oxybenzenesulfonate, and the highly preferred (6-nonanamidocaproyl) oxy benzene sulfonate, and mixtures thereof as described in EP-A-0170386.

Also suitable are precursor compounds of the benzoxazin-type, as disclosed for example in EP-A-332,294 and EP-A-482,807, particularly those having the formula:

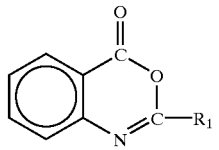

wherein $R_1$ is an alkyl, alkaryl, aryl, or arylalkyl containing at least 5 carbon atoms.

Still another class of hydrophobic bleach activators are the N-acylated precursor compounds of the lactam class disclosed generally in GB-A-955735. Preferred materials of this class comprise the caprolactams.

Suitable caprolactam bleach precursors are of the formula:

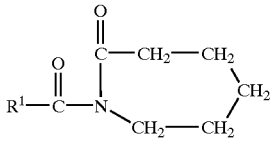

wherein $R^1$ is an alkyl, aryl, alkoxyaryl or alkaryl group containing from 6 to 12 carbon atoms. Preferred hydrophobic N-acyl caprolactam bleach precursor materials are selected from benzoyl caprolactam, octanoyl caprolactam, nonanoyl caprolactam, decanoyl caprolactam, undecenoyl caprolactam, 3,5,5-trimethylhexanoyl caprolactam and mixtures thereof. A most preferred is nonanoyl caprolactam.

Suitable valero lactams have the formula:

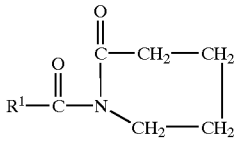

wherein $R^1$ is an alkyl, aryl, alkoxyaryl or alkaryl group containing from 6 to 12 carbon atoms. More preferably, $R^1$ is selected from phenyl, heptyl, octyl, nonyl, 2,4,4-trimethylpentyl, decenyl and mixtures thereof.

Mixtures of any of the peroxyacid bleach precursor, herein before described, may also be used.

A preferred class of organic peroxyacid compounds are the amide substituted compounds of the following general formulae:

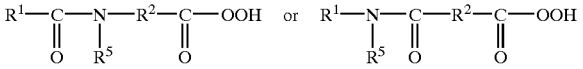

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Uses of the Polymeric Intimate Mixture and the Solid Component

The polymeric component may be used in any application whereby finely divided components are present or can be formed when exposed to pressure, to reduce the attrition of the finely divided component or the component or composition containing it, or the formation of dust.

Thus, the polymeric component may be used in any solid component or any composition whereby impact resistancy is needed to reduce the dusting of finely divided ingredients present in the component or composition.

In particular, the polymeric component can be used to improve the impact resistancy of component containing the sensitiser or preferably the enzymes or bleaching components, to thus reduce the formation of attrition dust under pressure, such as during handling.

Thus, the polymeric component can in particular be used in any composition or solid component which comprises sensitisers such as enzymes and bleaching components. Preferably, solid component is present in a detergent composition, the detergent composition may be a liquid composition comprising the solid component as a dispersed particle or preferably the composition being granular or in the form of a detergent tablet or detergent bar.

The detergent compositions herein can comprise any additional detergent ingredients, known in the art.

What is claimed is:

1. A solid component comprising from 30% to 95% by weight of a finely divided component which is a member selected from the group consisting of enzymes, bleach activators, and mixtures thereof, and a core-shell polymeric component present as a binder and/or a coating agent, wherein the core-shell polymeric component comprises a methacrylate-butadiene-styrene core and a polymethacrylate shell, whereby the solid component has a Stressed Heubach Index of less than 1000.

2. A solid component according to claim 1 having a Stressed Heubach Index of less than 500.

3. A solid component according to claim 1 having a Stressed Heubach Index of less than 200.

4. A solid component according to claim 1 wherein a part of the polymeric component is present as a binder that is intimately mixed with said finely divided component to form an intimate mixture and another part of said polymeric component is present as a coating agent, coating said intimate mixture.

5. A detergent composition comprising the solid component of claim 1 wherein said composition is in a form selected from the group consisting of a liquid detergent composition, a granular detergent composition, a detergent tablet, and a detergent bar.

6. A method to improve the impact resistance of a solid component according to claim 1, wherein the method comprises adding the core-shell polymeric component to said finely divided component whereby the impact resistance of said solid component is improved.

* * * * *